United States Patent [19]

Liu

[11] 4,043,241

[45] Aug. 23, 1977

[54] MUSICAL SHOE

[76] Inventor: Hsing-Ching Liu, 213, 3rd Floor, Section 4, Chung Ching North Road, Taipei, China /Taiwan

[21] Appl. No.: 710,381

[22] Filed: Aug. 2, 1976

[51] Int. Cl.[2] ..... G10H 1/00; G10H 5/04

[52] U.S. Cl. ..... 84/1.01; 36/139; 46/175 R; 46/232; 84/1.1; 84/DIG. 7; 84/DIG. 8; 84/DIG. 20

[58] Field of Search ..... 35/5; 46/174, 175 R, 46/232; 84/1.01, 1.09, 1.1, 1.27, 433, 470, DIG. 7, DIG. 8, DIG. 20; 36/112, 139; 128/382, 383; 273/1 E

[56] References Cited

U.S. PATENT DOCUMENTS

| | | | |
|---|---|---|---|
| 1,744,513 | 1/1930 | Smith | 46/232 X |
| 1,943,222 | 1/1934 | Landi | 36/139 X |
| 2,320,560 | 6/1943 | Braddock | 36/139 X |
| 2,644,248 | 7/1953 | Seligman | 36/139 X |
| 2,735,220 | 2/1956 | Miles | 36/139 X |
| 2,933,832 | 4/1960 | Ayala et al. | 46/175 R X |
| 2,940,184 | 6/1960 | Malone | 36/139 X |
| 3,501,144 | 3/1970 | Schmidt | 46/175 R X |
| 3,702,999 | 11/1972 | Gradisar | 36/139 X |
| 3,791,375 | 2/1974 | Pfeiffer | 46/175 R X |

*Primary Examiner*—Stanley J. Witkowski

*Attorney, Agent, or Firm*—Strauch, Nolan, Neale, Nies & Kurz

[57] ABSTRACT

A shoe provided with a plurality of keys on the underside thereof which when depressed will produce various musical tones by means of an electronic circuit provided inside the shoe.

5 Claims, 10 Drawing Figures

MUSICAL SHOE

BACKGROUND OF THE INVENTION

Heretofore, musical toys for children have been comprised mainly of miniature keyboards in the form of small pianos and the like. The object of such toys is to instill in children an appreciation of music and a general grasp of how major scales are constructed. None of these toys, however, are capable of giving children an appreciation for both music and dance at the same time.

It is, therefore, an object of the present invention to provide a musical shoe for children that will teach children simultaneously an appreciation for music and for dancing.

It is a further object of the present invention to provide musical shoes for children that are capable of producing at least eight tones of a major scale through a series of steps or motions of the feet upon which the shoes are worn.

It is yet a further purpose of the present invention to provide such a shoe whereby musical tones are produced electronically and are pleasant to the ear and are of suitable volume to be heard clearly.

Other purposes and advantages of the present invention will become obvious as the invention is described with reference to the appended drawings.

DETAILED DESCRIPTION OF THE INVENTION

Figure 1:
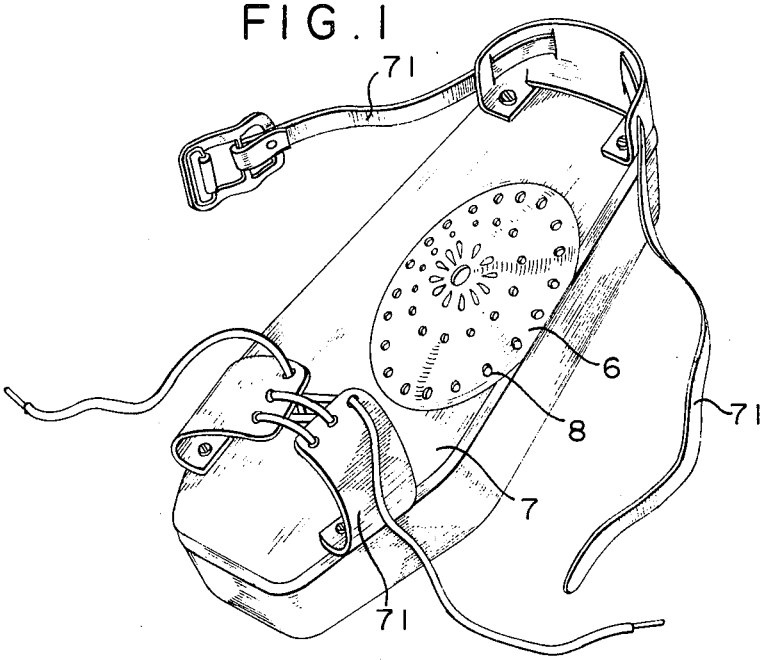
FIG. 1 is a perspective view of a musical shoe made according to the present invention.
Figure 2:
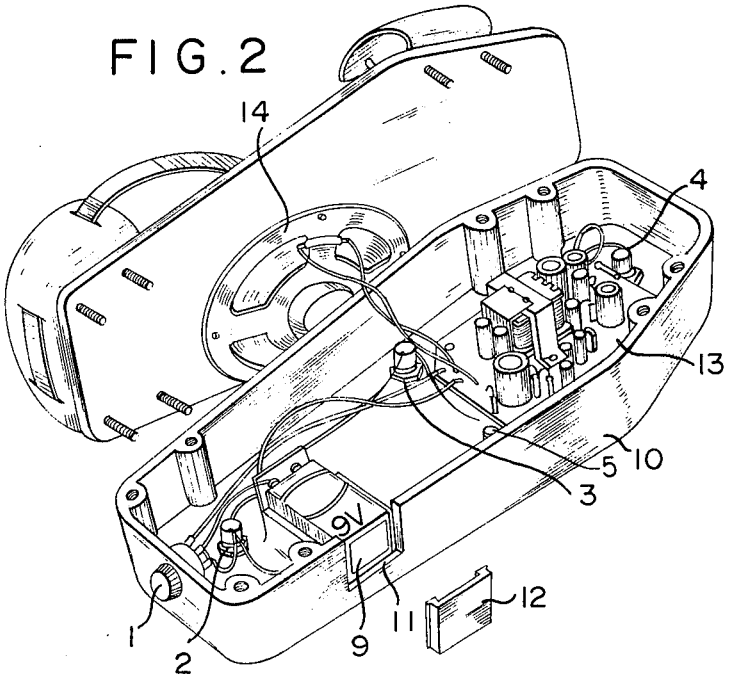
FIG. 2 is a similar view thereof showing the internal components.

As shown in FIGS. 1 and 2, a shoe is composed of an upper and lower half, the lower half 10 being made of a hard plastic or other suitable material and being hollow. The upper half 7 is provided with suitable straps 71 to secure the shoe safely to the foot. An arched plate 6 is provided on the upper half 7 in a place to correspond to the natural arch of the foot and is provided with a plurality of holes 8. Directly under the arched plate 6 is provided a speaker 14 which is connected to the electronic components by means of a printed circuit board 13. In the lower half 10 of the shoe is provided the sound producing components comprised mainly of a power supply 9, an on-off/volume control knob 1, piano key type switches 2, 3, 4, and 5 and a printed circuit board 13. The preferred power supply 9 is presently in the form of a battery. A hole 11 of suitable size is provided in the lower half 10 of the shoe and a cover 12 may be placed thereover.

Figure 3:
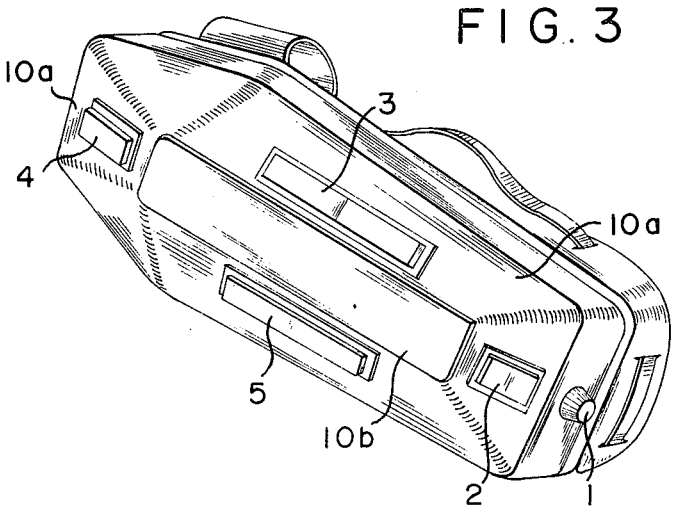
FIG. 3 is a perspective view of the bottom of a shoe made in accordance with the present invention.
Figure 4:
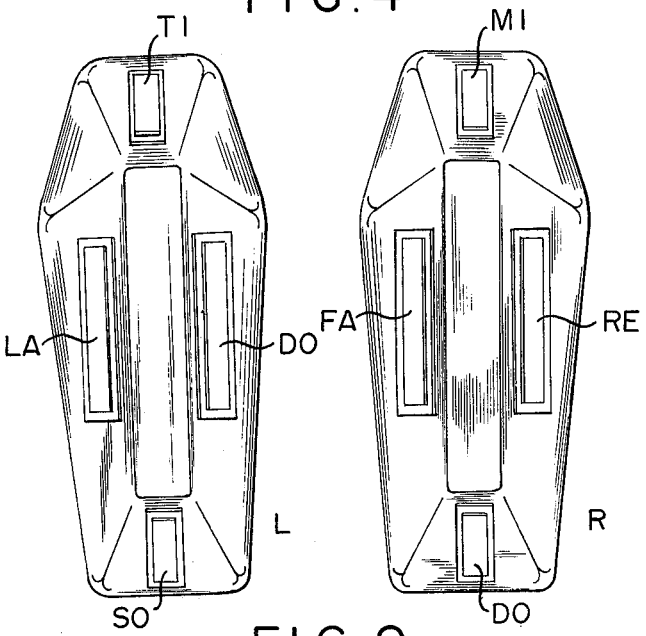
FIG. 4 is a plan view thereof, showing how keys to produce the eight tones of a major scale are distributed between the right shoe and the left shoe.

As shown in FIGS. 3 and 4 the bottom of the lower half 10 of the shoe is composed of at least four inclining sides 10*a* and a level base 10*b*. The switches 2, 3, 4, and 5 are highly sensitive key type switches and are inlayed into separate inclining sides 10*a*.

When depressed by means of pressing against a floor or hard surface with the foot, the switch at the heel of the right shoe R will cause the first tone of a major scale, or DO to be produced by the electronic circuit and be emanated from the speaker 14. As can be seen in FIG. 4, the tones DO, RE, MI, FA, SO, LA, TI and the octave DO may be produced by stepping on or otherwise depressing the switches located at the heel, outside, toe, and inside of each shoe respectively. By selectively altering the order in which various switches are depressed and the duration of the depression, simple melodies may be played as the feet are moved in dance like motions, as shown in FIGS. 5–8.

Figure 9:
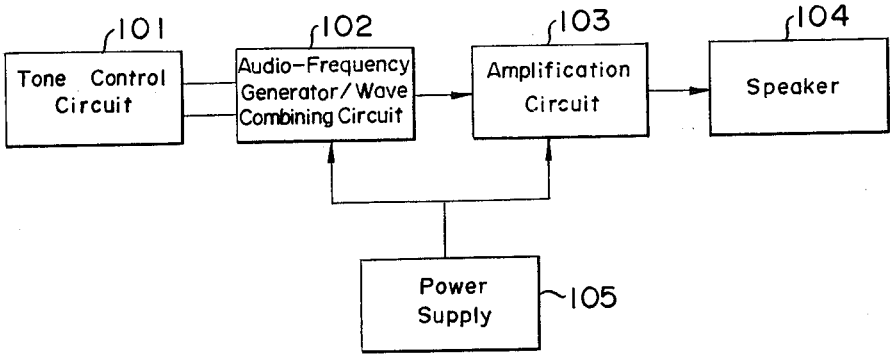
FIG. 9 is a block diagram of the circuit to produce musical tones in a shoe according to the present invention.
Figure 5:
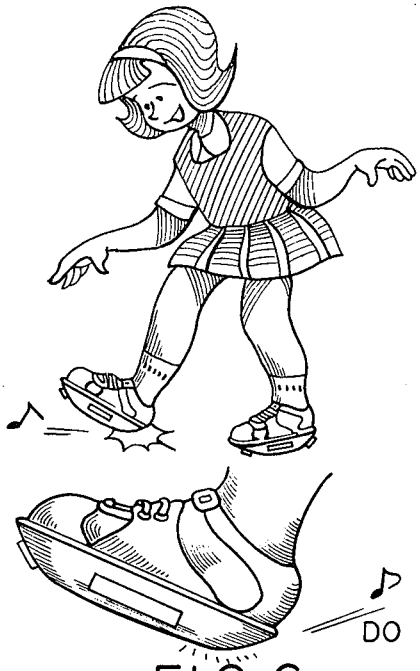
FIGS. 5–8 show the mode operation of a musical shoe according to the present invention.
Figure 7:
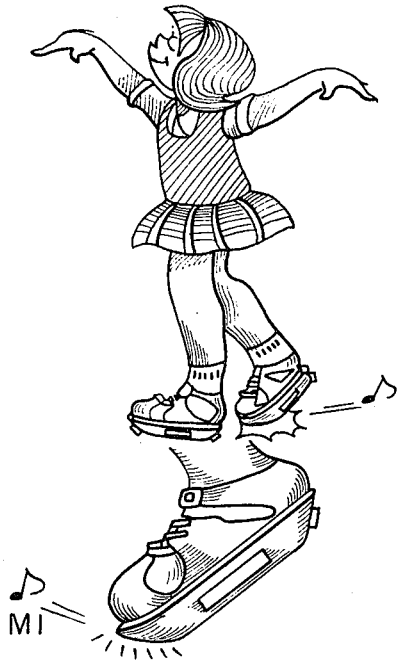
Figure 6:
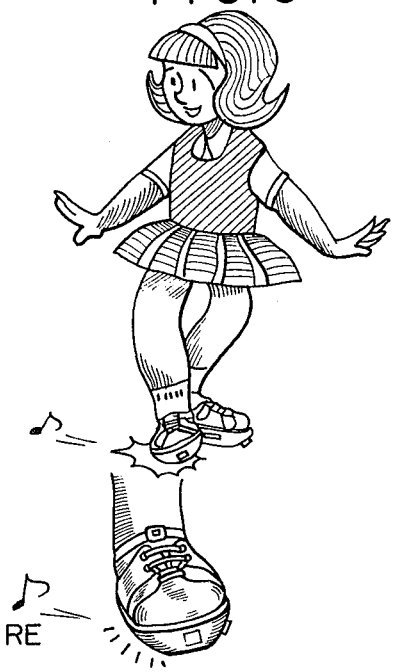
Figure 8:
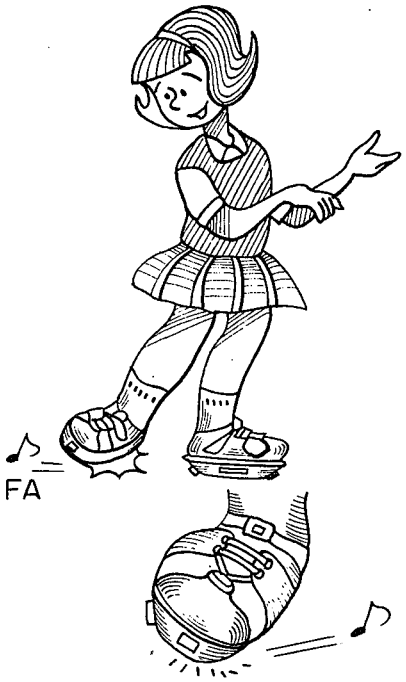

The electronic circuit employed to produce the various tones is similar in kind to those employed in electronic organs, comprising a power supply 105, a tone control circuit 101, an audio-frequency generator/wave combining circuit 102, an amplification circuit 103, and a speaker 104 (see FIG. 9).

Figure 10:
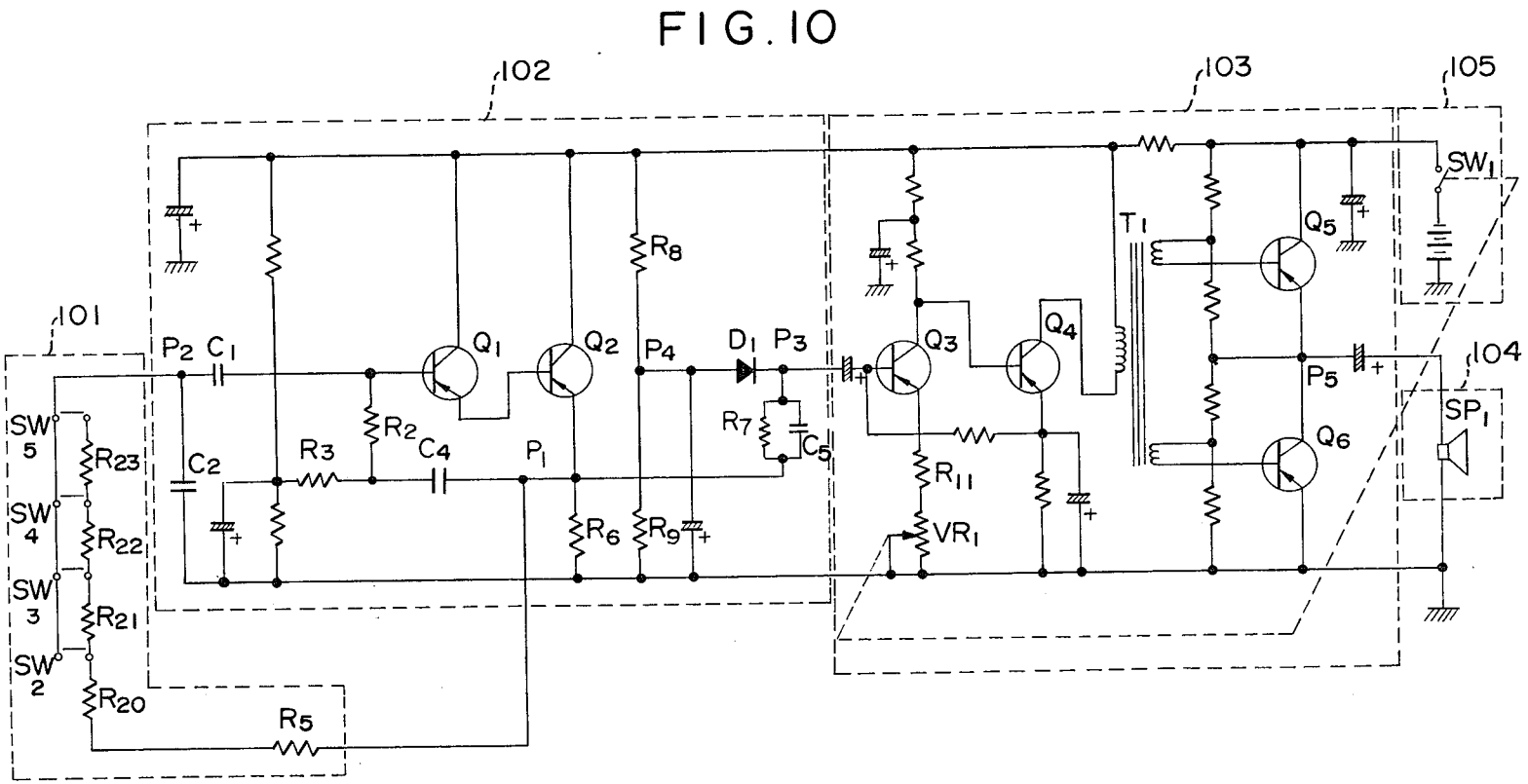
FIG. 10 is a detailed circuit diagram thereof.

As shown in FIG. 10, the tone control circuit 101 is comprised of resistors $R_5$, $R_{20}$, $R_{21}$, $R_{22}$, $R_{23}$ and tone control switches $SW_2$, $SW_3$, $SW_4$, and $SW_5$. When one of the switches $SW_2$, $SW_3$, $SW_4$ or $SW_5$ is closed, the rating of the resistors $R_x$ between terminals $P_1$ and $P_2$ will be either $R_5 + R_{20}$, $R_5 + R_{20} + R_{21}$, $R_5 + R_{20} + R_{21} + R_{22}$, or $R_5 + R_{20} + R_{21} + R_{22} + R_{23}$. The resistors $R_x$ with the capacitors $C_1$, $C_2$ and the capacitor $C_4$ with the resistors $R_2$, $R_3$ will form a twin-T circuit, and the Darlington circuit formed by transistors $Q_1$ and $Q_2$ form an oscillation loop circuit. The rating resistors $R_x$ may be tuned to different frequencies. The oscillating output of transistor $Q_2$ passes from the terminal $P_1$ to the high-pass wave filter of the resistor $R_7$ and capacitor $C_5$ causes the output of higher frequency to be of less attenuation at terminal $P_3$. The DC bias voltage at $P_3$ is determined by resistors $R_6$ and $R_7$ and the DC bias voltage at $P_4$ is determined by resistors $R_8$ and $R_9$. A suitable DC bias voltage at $P_3$ and $P_4$ may be obtained by adjusting the values of the resistors $R_6$, $R_7$, $R_8$, and $R_9$, causing the output of regular waves of the transistor $Q_2$ to terminal $P_3$ by means of a diode $D_1$ to produce high order harmonic waves. The combined wave pattern of the regular waves and the harmonic waves will produce a musical tone similar to that produced by electronic organs. This signal is then passed to the amplification circuit 103.

The transistors $Q_3$ and $Q_4$ form a two-stage directed coupled amplified circuit. The input transformer $T_1$ serves as impedance match for power transistors $Q_5$ and $Q_6$ and transistor $Q_4$. Therefore, the greatest output can be obtained at the terminal $P_5$ which emanates from the speaker $SP_1$ as an organ-like tone of a specified pitch. In addition, a variable resistor $VR_1$ is connected in series to an emitter's resistor $R_{11}$ so that the amplifier gain of the transistors $Q_3$ and $Q_4$ may be regulated, thereby controlling the volume of emitted sound. The value of $VR_1$ may be controlled by turning of the switch $SW_1$.

By employing the above described circuit in the hollow bottom of an elevated shoe in combination with a plurality of switches which may be separately depressed, and by assigning each switch a specific tonal quality, it is possible to provide a shoe whereby simple melodies may be produced by simple dance like steps by the wearer.

I claim:

1. A musical shoe for children comprised of a separable upper and lower half, the upper half being flat and provided with straps for the purpose of securing the shoe to the foot and having a plurality of holes and a speaker provided thereunder; said lower half having a base portion and at least four inclining sides, said lower half also being hollow and provided internally with an electronic circuit including a power source, a plurality of switches which when closed cause the electronic circuit to produce various musical tones which are emitted from said speaker, and an on-off/volume control switch.

2. A musical shoe as in claim 1 wherein said plurality of switches are piano key type switches provided on the said inclined sides of the lower half of the shoe, having no more than one switch to each inclined side.

3. A shoe as in claim 2, wherein when the shoe has been secured to the foot by means of the straps musical tones may be produced by shifting the foot to cause one of the said plurality of switches to be depressed.

4. A musical shoe as in claim 3, wherein by selectively causing different switches to be depressed, simple melodies may be produced.

5. A musical shoe as in claim 1 wherein said upper half also includes an arched portion corresponding to the natural arch of the foot, having said plurality of holes provided therethrough and said speaker provided thereunder.

* * * * *